US006619479B2

(12) United States Patent
Jones et al.

(10) Patent No.: US 6,619,479 B2
(45) Date of Patent: Sep. 16, 2003

(54) PROMOTIONAL BAG DISPENSING APPARATUS

(75) Inventors: Robert A. Jones, Raleigh, NC (US); Jason S. Holland, Raleigh, NC (US); Brenda S. Jones, Raleigh, NC (US)

(73) Assignee: Adstracts, Inc., Raleigh, NC (US)

( * ) Notice: Subject to any disclaimer, the term of this patent is extended or adjusted under 35 U.S.C. 154(b) by 72 days.

(21) Appl. No.: 10/054,221

(22) Filed: Jan. 22, 2002

(65) Prior Publication Data

US 2003/0136703 A1 Jul. 24, 2003

(51) Int. Cl.[7] ..... B65D 1/34

(52) U.S. Cl. ..... 206/554; 24/501; 24/511; 248/452; 248/229.25

(58) Field of Search ..... 206/554, 730; D8/395; D19/65, 86; 24/489, 500, 501, 502, 511; 248/450, 452, 229.25, 229.26; 383/22, 92, 203

(56) References Cited

U.S. PATENT DOCUMENTS

| | | | | | |
|---|---|---|---|---|---|
| 3,126,094 | A | * | 3/1964 | Arnold et al. | 206/554 |
| 3,727,829 | A | * | 4/1973 | Huni | 383/203 |
| D257,158 | S | | 9/1980 | Olsson | |
| 4,506,416 | A | * | 3/1985 | Ohminato et al. | 24/489 |
| 4,537,330 | A | | 8/1985 | Gelbard | |
| D294,006 | S | | 2/1988 | Gygax et al. | |
| D302,568 | S | | 8/1989 | Berger | |
| D306,876 | S | | 3/1990 | Greenhut et al. | |
| 4,983,047 | A | * | 1/1991 | Netto | 383/92 |
| 5,079,808 | A | * | 1/1992 | Brown | 24/511 |
| D335,078 | S | | 4/1993 | Hampshire | |
| D348,902 | S | | 7/1994 | Beyer | |
| D352,314 | S | | 11/1994 | Wolff | |
| D364,188 | S | | 11/1995 | Wolff | |
| 5,524,762 | A | | 6/1996 | Shafran et al. | |
| D376,534 | S | | 12/1996 | Wolff | |
| D392,181 | S | | 3/1998 | Bries et al. | |
| 5,772,035 | A | | 6/1998 | Harrison | |
| 5,788,080 | A | | 8/1998 | Sill et al. | |
| 5,826,724 | A | * | 10/1998 | Gebhardt | 206/554 |
| D400,584 | S | | 11/1998 | Wolff | |
| 5,860,529 | A | | 1/1999 | Smithson et al. | |
| D406,167 | S | | 2/1999 | Wolff | |
| D406,168 | S | | 2/1999 | Wolff | |
| D406,169 | S | | 2/1999 | Wolff | |
| D406,170 | S | | 2/1999 | Wolff | |
| D406,171 | S | | 2/1999 | Wolff | |
| 5,966,741 | A | | 10/1999 | Klecina | |
| D428,921 | S | | 8/2000 | Saylor et al. | |
| 6,116,424 | A | | 9/2000 | Leu | |
| 6,142,302 | A | | 11/2000 | Requena | |
| 6,302,366 | B1 | | 10/2001 | Saylor et al. | |

* cited by examiner

*Primary Examiner*—Luan K. Bui
(74) *Attorney, Agent, or Firm*—Myers Bigel Sibley & Sajovec

(57) ABSTRACT

Distinctive, promotional bag dispensing apparatus are provided that include a clamp and a clip configured to retain a plurality of plastic (or other) bags in stacked adjacent relationship. Each clamp includes a base member and a retaining member that is movably secured to the base member via hinges for pivotal movement about an axis thereof. A plurality of spaced-apart posts extend from the front surface adjacent the forward edge portion. Each clip has a U-shaped configuration with adjacent, spaced-apart first and second panels that are configured to receive and retain header portions of a plurality of bags in stacked adjacent relationship positioned therebetween. The first and second panels each comprise a plurality of spaced-apart apertures. The respective apertures in the first panel are aligned with the respective apertures in the second panel so as to removably receive the respective plurality of spaced-apart posts extending from the base member front surface therethrough such that the clip is removably secured to the clamp.

31 Claims, 8 Drawing Sheets

PROMOTIONAL BAG DISPENSING APPARATUS

FIELD OF THE INVENTION

The present invention relates generally to bag dispensers and, more particularly, to stacked plastic bag dispensers.

BACKGROUND OF THE INVENTION

The use of promotional items has proliferated in today's increasingly competitive marketplace, where companies are constantly seeking more effective and new ways to market their products. In the healthcare industry, physicians and other healthcare providers often receive promotional articles from vendors of healthcare-related products, such as pharmaceutical products. These promotional articles often include "everyday" items, such as writing pads, calendars, containers, and pens that have promotional information (indicia) printed thereon. For example, pharmaceutical companies often provide physicians with writing pens having the name of a particular pharmaceutical product printed thereon with the hopes that the pens will help remind the physicians to prescribe the particular pharmaceutical product.

In addition, physicians and other healthcare providers often receive samples of various pharmaceutical products which they give to patients. These samples are often carried by patients via plastic bags similar to those utilized by retail establishments. Unfortunately, devices that have been developed for use in dispensing plastic bags are geared more towards retail establishment use and can be somewhat bulky and expensive. Accordingly, it would be desirable to provide plastic bag dispensing devices that could be utilized easily by physicians and other healthcare providers and that are distinctive and effective in promoting products.

SUMMARY OF THE INVENTION

In view of the above discussion, bag dispensing apparatus that are distinctive and that can be effective in promoting products are provided for use by physicians and other healthcare providers. According to embodiments of the present invention, a bag dispensing apparatus includes a clamp and a clip configured to retain a plurality of plastic (or other) bags in stacked adjacent relationship. Each bag has a receptacle portion that is separable from a respective header portion via perforations therebetween. A user grasps the receptacle portion of a bag and pulls to separate the receptacle portion from the header portion which is retained within the clip.

According to embodiments of the present invention, the clamp includes a base member and a retaining member that is movably secured to the base member via hinges for pivotal movement about an axis thereof. The base member has opposite front and rear surfaces and a forward edge portion. A plurality of spaced-apart posts extend from the front surface adjacent the forward edge portion.

According to embodiments of the present invention, the retaining member has opposite front and rear surfaces and opposite forward and rear edge portions. According to embodiments of the present invention, the base member has a generally planar configuration and the retaining member has a generally arcuate configuration. The rearward edge portion of the retaining member may have an arcuate configuration that facilitates a user pressing thereon to separate the forward edge portions of the base and retaining members. A spring element is configured to bias the retaining member about an axis such that the retaining member forward edge portion is urged towards the base member forward edge portion.

The clip has a U-shaped configuration with adjacent, spaced-apart first and second panels that are configured to receive and retain header portions of a plurality of bags in stacked adjacent relationship positioned therebetween. The first and second panels each comprise a plurality of spaced-apart apertures. The respective apertures in the first panel are aligned with the respective apertures in the second panel so as to removably receive the respective plurality of spaced-apart posts extending from the base member front surface therethrough such that the clip is removably secured to the clamp.

When the clip is positioned within the clamp such that the posts are engaged with the apertures in the first and second panels of the clip, the base member forward edge portion and the retaining member forward edge portion are configured to grip the header portions of the plurality of bags adjacent the clip. Gripping by the forward edge portions of the base and retaining members helps retain the header portions of the bags within the clip when a user applies a force to a bag to separate a receptacle portion from a respective header portion.

According to embodiments of the present invention, the base member may have one or more apertures formed therein that are configured to support the bag dispensing apparatus on a surface. The base member may also include a magnet attached to the rear surface thereof that is configured to removably secure the bag dispensing apparatus to a magnetically attractive surface. According to embodiments of the present invention, promotional indicia may be provided on one or more portions of the clamp and/or clip. In addition, promotional indicia may be provided on portions of the bags.

BRIEF DESCRIPTION OF THE DRAWINGS

The accompanying drawings, which form a part of the specification, illustrate key embodiments of the present invention. The drawings and description together serve to fully explain the invention.

DETAILED DESCRIPTION OF THE INVENTION

Figure 1:
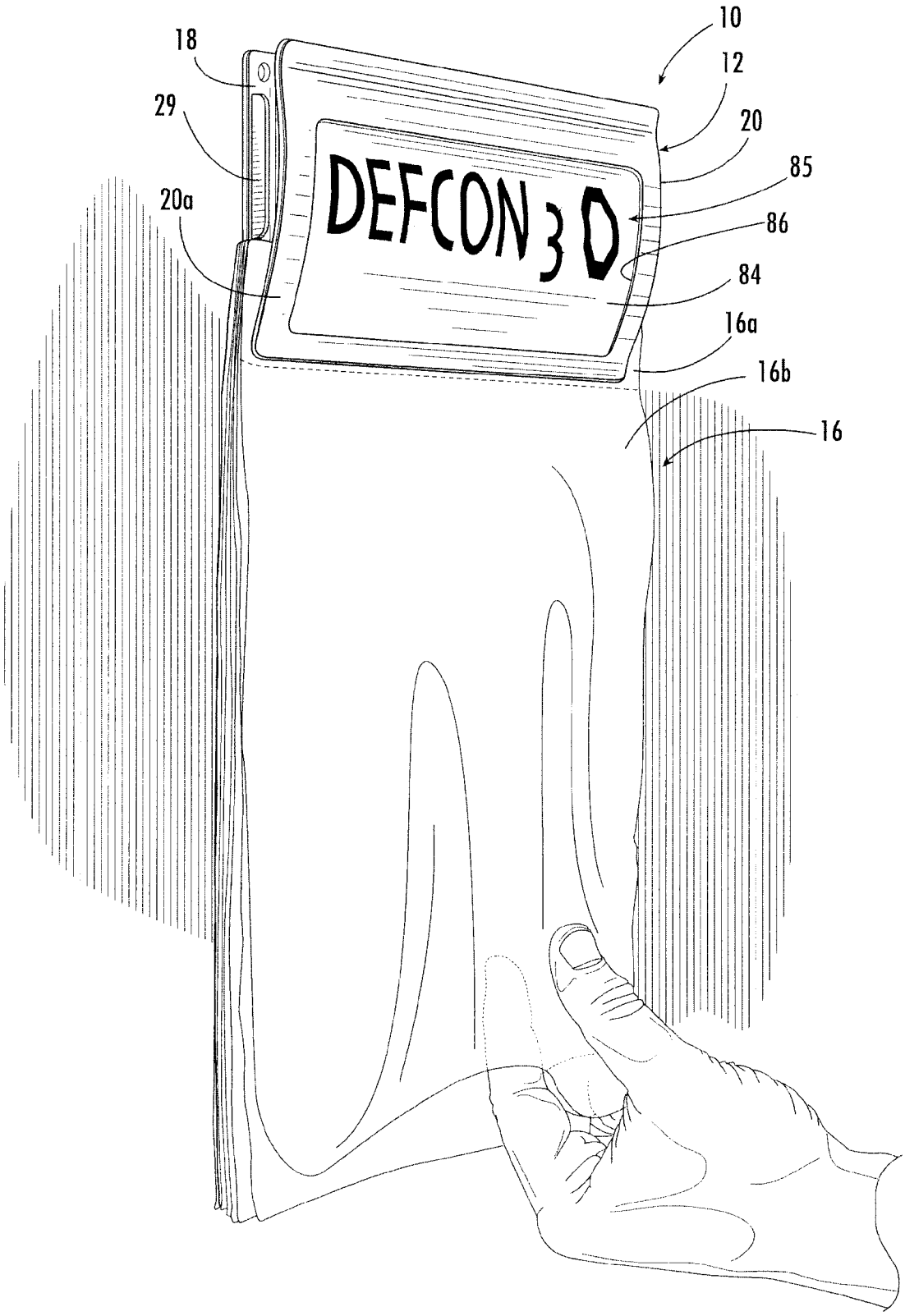
FIG. 1 is perspective view of a bag dispensing apparatus according to embodiments of the present invention.
Figure 2:
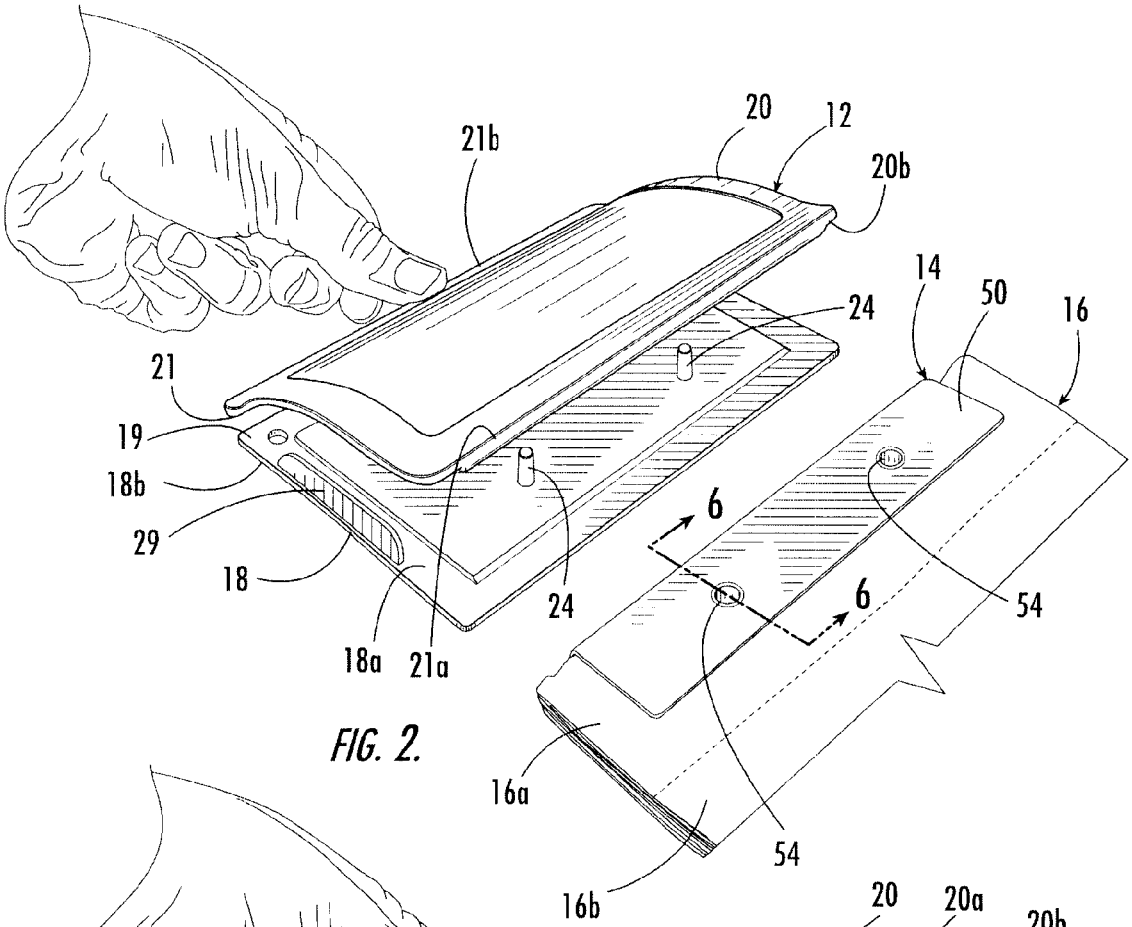
FIG. 2 is a perspective view of a bag dispensing apparatus according to embodiments of the present invention with the clamp in an open position and configured to receive a clip holding a plurality of stacked bags.
Figure 3:
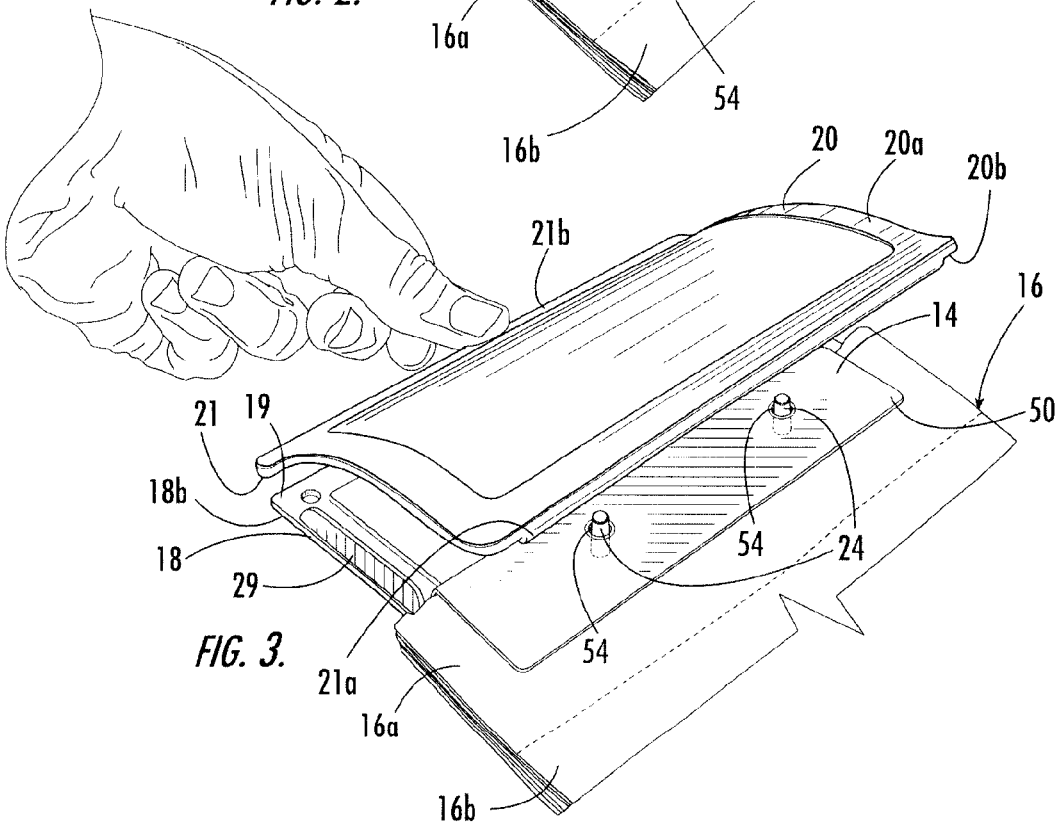
FIG. 3 illustrates the bag dispensing apparatus of FIG. 2 with the clip removably secured within the clamp.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the thickness of lines, layers and regions may be exaggerated for clarity. It will be understood that when an element such as a layer, region, substrate, or panel is referred to as being "on" another element, it can be directly on the other element or intervening elements may also be present. In contrast, when an element is referred to as being "directly on" another element, there are no intervening elements present. It will be understood that when an element is referred to as being "connected" or "attached" to another element, it can be directly connected or attached to the other element or intervening elements may also be present. In contrast, when an element is referred to as being "directly connected" or "directly attached" to another element, there are no intervening elements present.

Embodiments of the present invention can provide a distinctive promotional bag dispensing apparatus that is compact, lightweight, and that can be mounted to various surfaces in various ways. Referring initially to FIGS. 1–4, a bag dispensing apparatus 10 according to embodiments of the present invention includes a clamp 12 and a clip 14 configured to retain a plurality of bags 16 in stacked adjacent relationship. The illustrated clamp 12 includes a base member 18 and a retaining member 20 that is movably secured to the base member 18 via hinges 22 (FIG. 5) for pivotal movement about an axis A. The base member 18 has opposite front and rear surfaces 18*a*, 18*b* and a forward edge portion 19. A plurality of spaced-apart posts 24 extend from the front surface 18*a* adjacent the forward edge portion 19, as illustrated. The retaining member 20 has opposite front and rear surfaces 20*a*, 20*b* and opposite forward and rear edge portions 21*a*, 21*b*.

Each bag 16 has a receptacle portion 16*b* that is separable from a respective-header portion 16*a* via perforations 17 therebetween. A user grasps the receptacle portion 16*b* of a bag 16 and pulls to separate the receptacle portion 16*b* from the header portion 16*a* which is retained within the clip 14.

In the illustrated embodiment, the base member 18 has a generally planar configuration and the retaining member 20 has a generally arcuate configuration. However, the base and retaining members 18, 20 may have various shapes, sizes and configurations according to embodiments of the present invention. The rearward edge portion 21*b* of the retaining member 20 has an arcuate configuration, as illustrated. This arcuate configuration facilitates a user pressing thereon to separate the forward edge portions 19, 21*a* of the base and retaining members 18, 20.

The base and retaining members 18, 20 may be formed from various types of materials without limitation (e.g., polymeric materials, metals, wood, etc.). When formed from polymeric materials, the base and/or retaining members 18, 20 may be configured to have a translucent or opaque appearances or combinations thereof.

Figure 5:
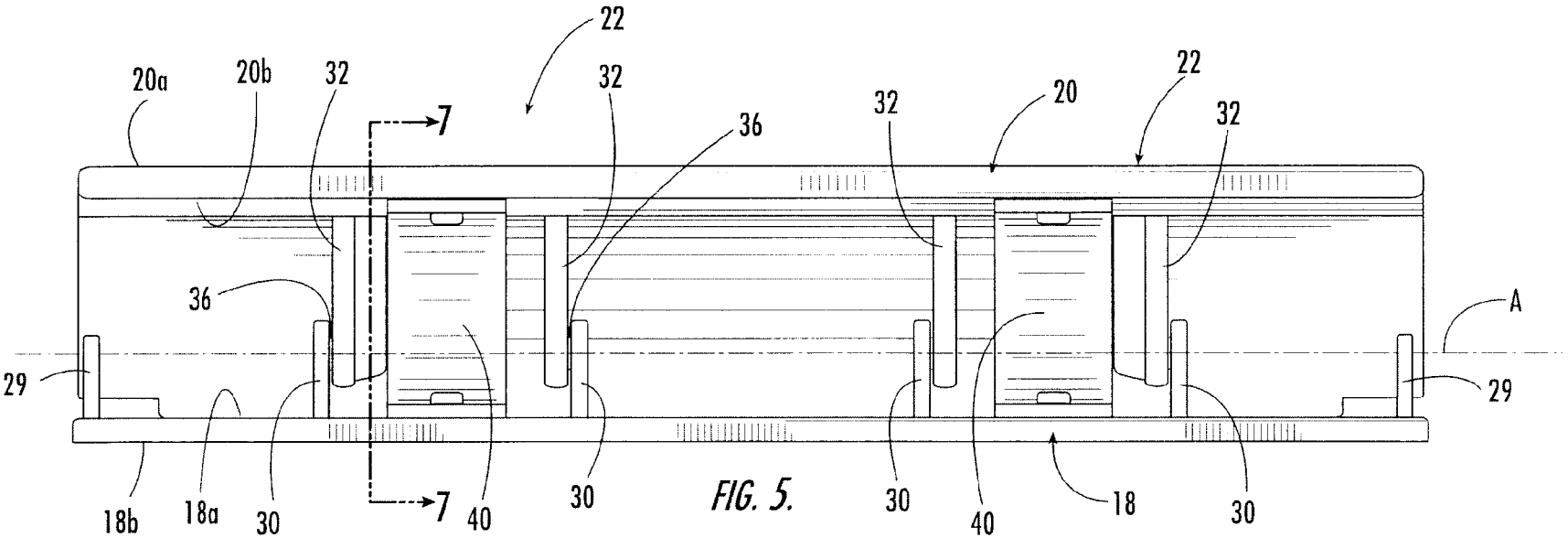
FIG. 5 is a rear elevation view of the clamp of the bag dispensing apparatus of FIG. 1 illustrating the two pairs of hinges that pivotally attach the retaining member to the base member.

In the illustrated embodiment, two pairs of spaced-apart hinges 22 are utilized to pivotally attach the retaining member 20 to the base member 18. Referring to FIG. 5 each hinge 22 includes a first member 30 extending from the base member front surface 18*a* and a second member 32 extending from the retaining member rear surface 20*b*. The first and second members 30, 32 of each hinge 22 are pivotally connected to each other via pin 36. The pin 36 may be integrally formed with either the first or second member 30, 32 and extend therefrom so as to be received within an aperture in the other member to provide pivotal movement of the first and second members 30, 32 relative to one another. Alternatively, the pin 36 may be a separate member that is received in respective apertures in the first and second members 30, 32 as would be understood by those skilled in the art.

As illustrated in FIG. 5 a spring element 40 is positioned between each respective pair of spaced-apart hinges 22 and is configured to bias the retaining member 20 about the axis A such that the retaining member forward edge portion 21*a* is urged towards the base member forward edge portion 19. The illustrated spring element 40 is a leaf-type spring having opposite end portions 40*a*, 40*b*. End portion 40*a* is securely attached to the retaining member rear surface 20*b* and opposite end portion 40*b* is securely attached to the base member front surface.

Embodiments of the present invention are not limited to the illustrated hinge 22 and spring element 40 configurations. Various types, shapes and configurations of hinges and springs may be utilized in accordance with embodiments of the present invention. Moreover, springs may be attached to the retaining member 20 and base member 18 is various ways to facilitate pivotal movement about axis A.

Figure 6:
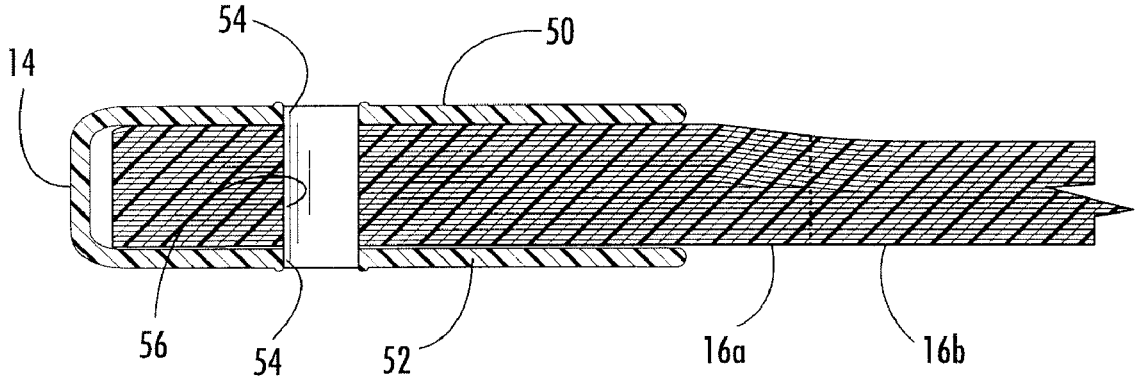
FIG. 6 is a cross-sectional view of the clip of FIG. 2 taken along lines 6—6.

Referring to FIG. 6, the illustrated clip 14 has a U-shaped configuration with adjacent, spaced-apart first and second panels 50, 52 that are configured to receive and retain header portions 16*a* of a plurality of bags 16 in stacked adjacent relationship positioned therebetween. The first and second panels 50, 52 each comprise a plurality of spaced-apart apertures 54. The respective apertures 54 in the first panel 50 are aligned with the respective apertures 54 in the second panel 52 so as to removably receive the respective plurality of spaced-apart posts 24 extending from the base member front surface 18*a* therethrough such that the clip 14 can be removably secured to the clamp 12. The apertures 54 in each panel are preferably separated by a distance of between about one and six inches (1–6 in.); however, virtually any amount of separation is within the scope of the present invention.

In the illustrated embodiment, a hollow tube 56 extends between the first and second panels 50, 52 and terminates at each pair of aligned apertures 54 in the first and second panels 50, 52. Each hollow tube 56 is configured to removably receive a respective post 24 extending from the base member front surface 18*a* therethrough. Each hollow tube 56 also extends through the header portions 16*a* of the plurality of bags 16 and serves to retain the bags 16 within the clip 14.

Figure 4:
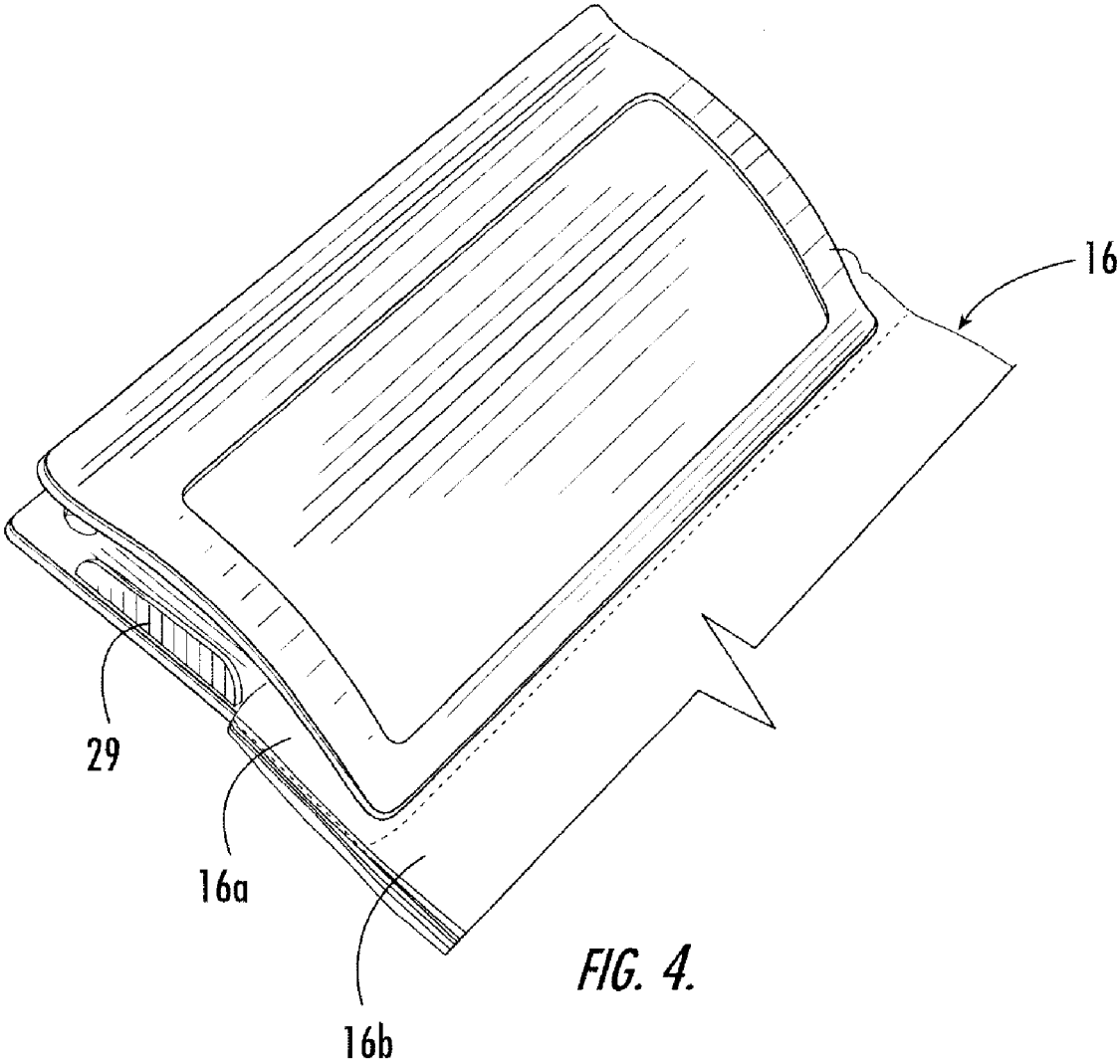
FIG. 4 illustrates the bag dispensing apparatus of FIG. 2 with the clip removably secured within the clamp and with the clamp in a closed position such that the retaining member and base member forward edge portions grip the plurality of bag headers.

When the clip 14 is positioned within the clamp 12 such that the posts 24 are engaged with the clip apertures 54, the base member forward edge portion 19 and the retaining member forward edge portion 21*a* are configured to grip the header portions 16*a* of the plurality of bags 16 adjacent the clip 14, as illustrated in FIG. 4. Gripping by the forward edge portions 19, 21*a* of the base and retaining members 18, 20 helps retain the header portions 16*a* of the bags 16 within the clip 14 when a user applies a force to a bag 16 to separate a receptacle portion 16*b* from a respective header portion 16*a*.

Figure 9:
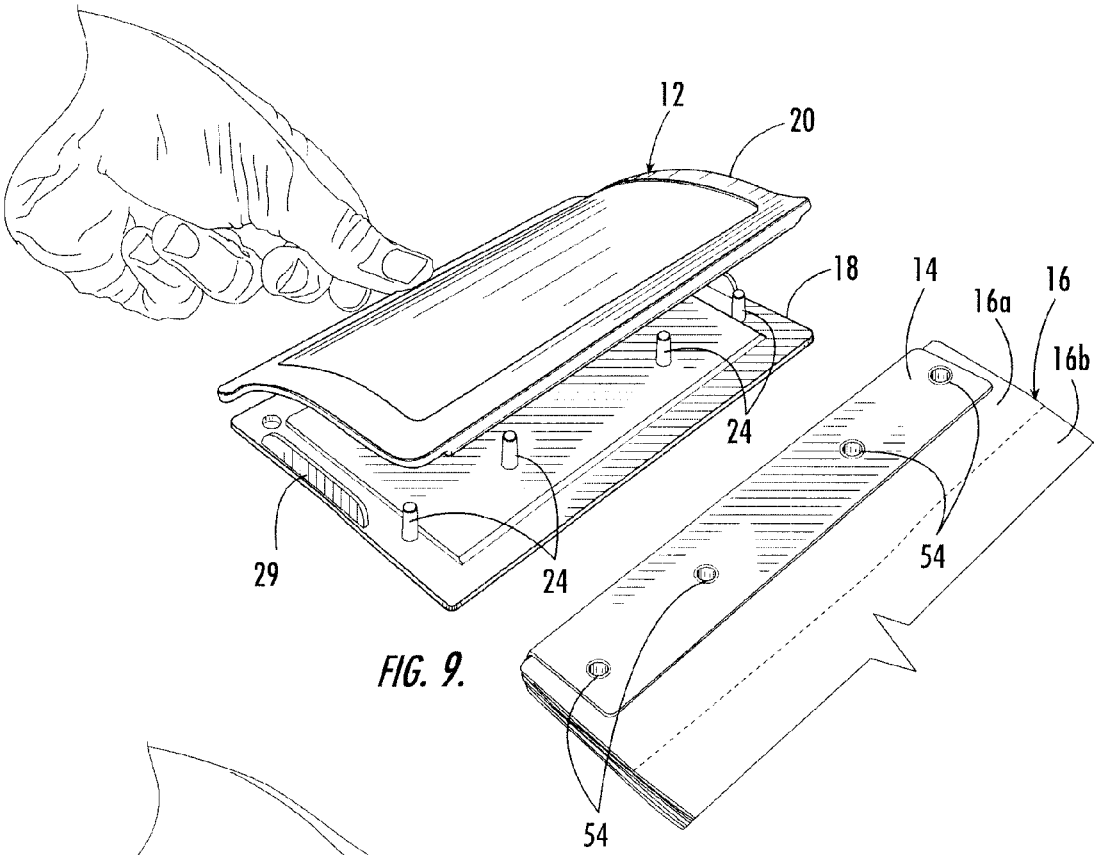
FIG. 9 is a perspective view of a bag dispensing apparatus according to alternative embodiments of the present invention with the clamp in an open position and configured to receive a clip holding a plurality of stacked bags.
Figure 10:
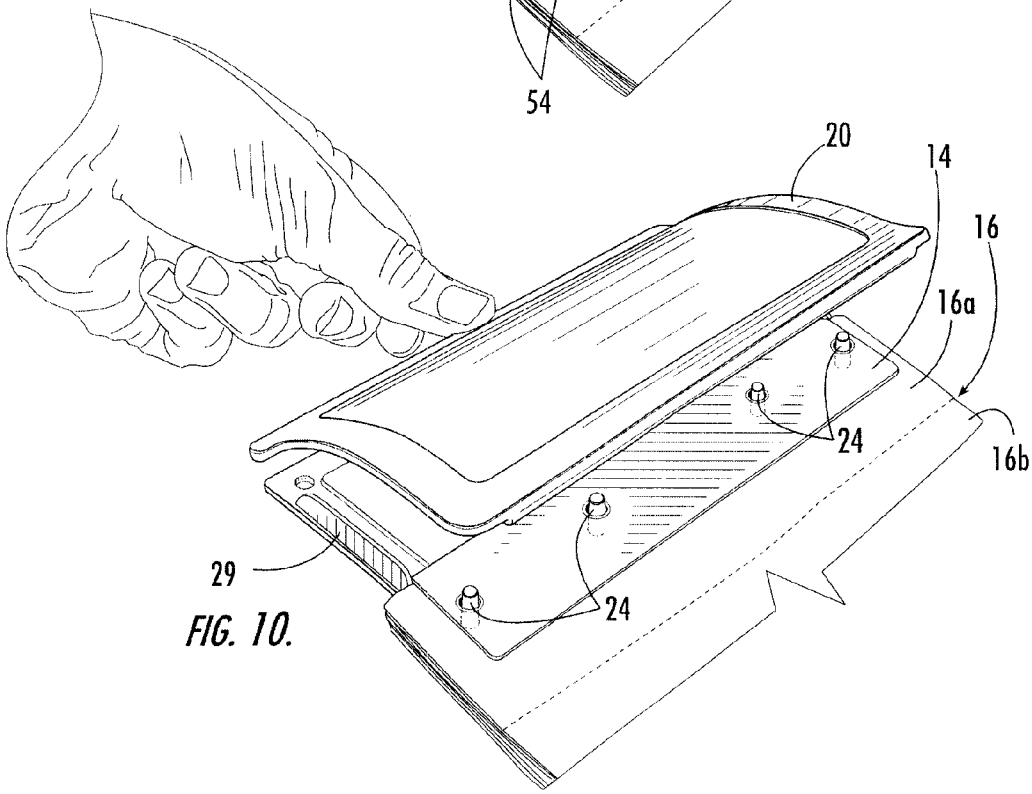
FIG. 10 illustrates the bag dispensing apparatus of FIG. 9 with the clip removably secured within the clamp.

According to embodiments of the present invention, the clip 14 may include two pairs of spaced-apart apertures 54 as illustrated in FIGS. 9–10. Preferably, the apertures 54 in each pair are separated from each other by a distance of between about one and three inches (1–3 in.); however, virtually any amount of separation is within the scope of the present invention. The respective apertures 54 in the first panel 50 are aligned with the respective apertures 54 in the second panel 52 so as to removably receive the respective two pairs of spaced-apart posts 24 extending from the base member front surface 18*a* therethrough such that the clip 14 is removably secured to the clamp 12.

Referring back to FIGS. 7–8, the retaining member 20 may include one or more members extending from the retaining member rear surface 20*b* adjacent the retaining member forward edge portion 21*a* that facilitate gripping the header portions 16*a* of bags 16 adjacent the clip 14. In the illustrated embodiment, a rib 25 is provided to serve this function. However, various numbers of members having various shapes and configurations may be utilized, without limitation.

Figure 7:
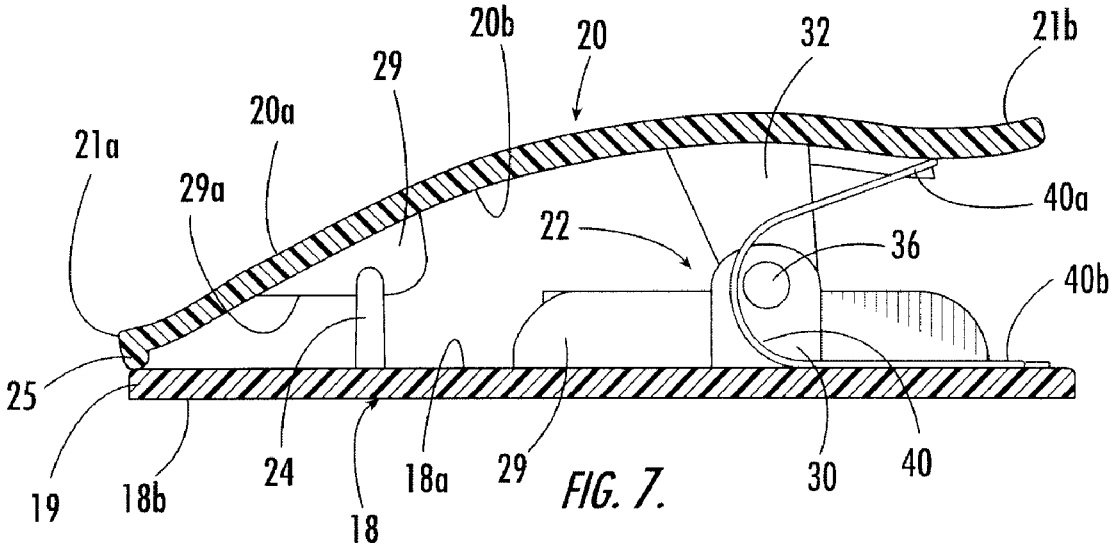
FIG. 7 is a cross-sectional view of the clamp of FIG. 5 taken along lines 7—7 with the clamp in a closed configuration.
Figure 8:
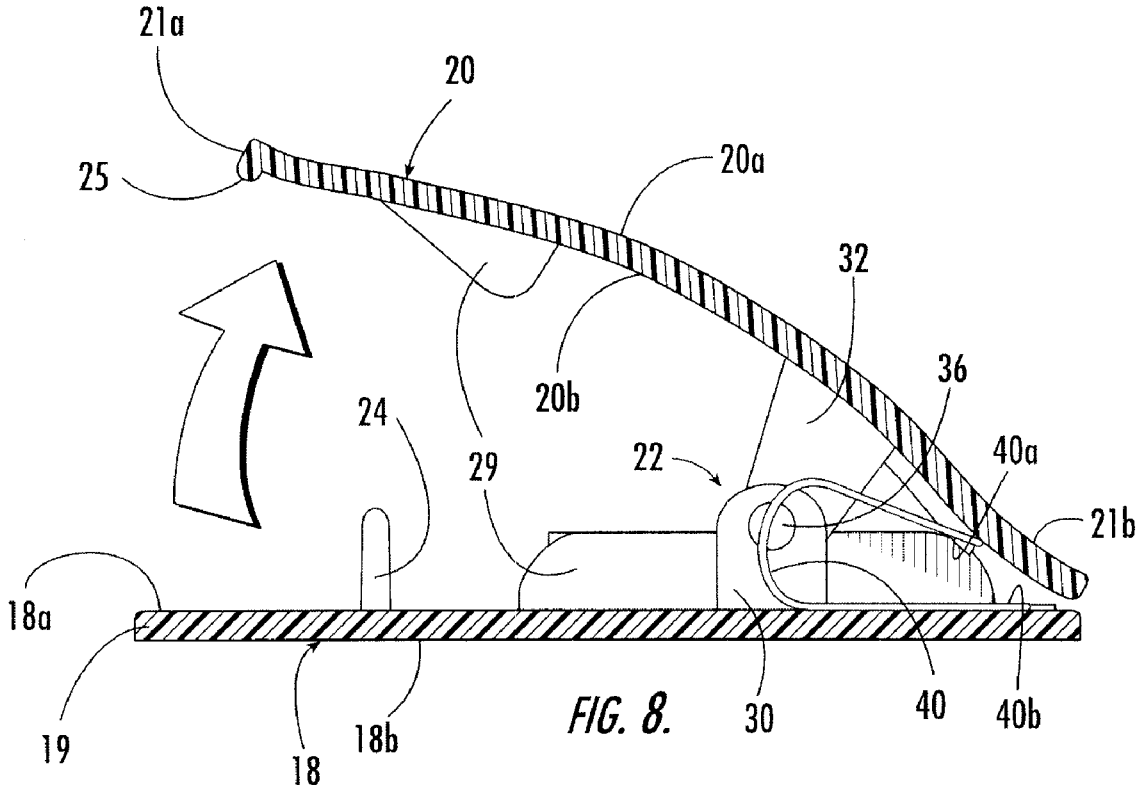
FIG. 8 is a cross-sectional view of the clamp of FIG. 5 taken along lines 7—7 with the clamp in an open configuration.

In the illustrated embodiment, stiffening members 29 may be provided in various locations of the clamp 12. For example, in FIG. 7, stiffening members 29 extend from the retaining member rear surface 20*b* adjacent the forward edge portion 21*a*. Stiffening members 29 also extend from the base member front surface 18*a* adjacent one or more of the hinges 22, as illustrated in FIG. 7. In addition, stiffening members 29 may extend from the base member front surface 18*a* adjacent side portions of the base member 18, as illustrated in FIG. 1. These stiffening members 29 are configured to add structural stiffness to the clamp 12. In addition, one or more of the stiffening members 29 may serve the function of guiding the clip 14 into position to be removably secured within the clamp 12. The illustrated stiffening members 29 extending from the retaining member rear surface 20*b* (FIG. 7) have a flat portion 29*a* that is configured to apply compressive force on bag headers 16*a* disposed within the clamp 12.

Figure 11:
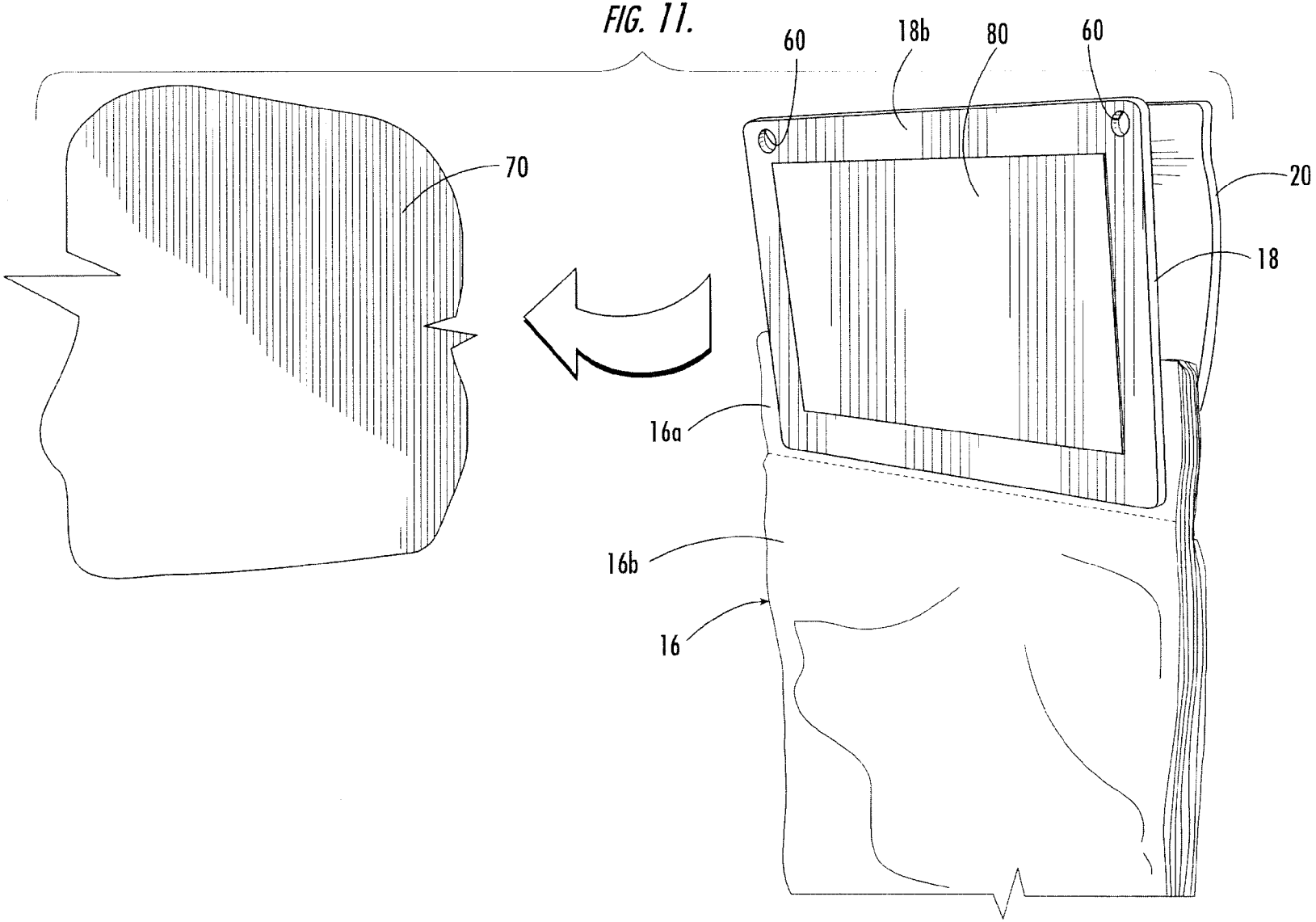
FIG. 11 is a perspective view of the bag dispensing apparatus of FIG. 1 illustrating a magnet attached to the base member for removably securing the clamp to a magnetically attractive surface.

Referring now to FIG. 11, the base member 18 may have one or more apertures 60 formed therein that are configured to support the bag dispensing apparatus 10 on a surface 70. For example, surface 70 may be a wall and apertures 60 may be configured to receive supporting members therethrough that extend outwardly from the wall (e.g., hooks, screws, nails, etc.). The illustrated base member 18 also includes a magnet 80 attached to the rear surface 18*b* thereof that is configured to removably secure the bag dispensing apparatus to a magnetically attractive surface.

According to embodiments of the present invention, promotional indicia may be provided on one or more portions of the clamp 12 and/or clip 14. In addition, promotional indicia may be provided on portions of the bags 16. Referring back to FIG. 1, the illustrated retaining member front surface 20*a* includes a substrate (e.g., a label) 84 having promotional indicia 85 disposed thereon. In the illustrated embodiment, the label 84 is disposed within a recessed portion 86 formed within the retaining member front surface 20*a*. According to embodiments of the present invention, the recessed portion 86 may have various shapes, sizes and/or configurations. Moreover, more than one recessed portion containing promotional indicia may be provided according to embodiments of the present invention. The label 84 may be substantially flush with the retaining member recessed portion 86. Alternatively, the label 84 may have a non-flush configuration relative to the retaining member recessed portion 86.

According to embodiments of the present invention, the retaining member front surface 20*a* need not contain a recessed portion. A substrate containing promotional indicia may be disposed directly on the front surface 20*a* of the retaining member. In addition, promotional indicia may be disposed directly on the retaining member front surface 20*a* without requiring a substrate such as a label.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A bag dispensing apparatus, comprising:

a clamp, comprising:

a base member comprising opposite front and rear surfaces, a forward edge portion, and a plurality of spaced-apart posts extending from the front surface adjacent the edge portion;

a retaining member comprising opposite front and rear surfaces and a forward edge portion, wherein the retaining member is movably secured to the base member for pivotal movement about an axis;

at least one biasing member configured to bias the retaining member about the axis such that the retaining member forward edge portion is urged towards the base member forward edge portion; and a clip configured to retain header portions of a plurality of bags in stacked adjacent relationship, wherein each bag has a receptacle portion that is separable from a respective header portion via perforations therebetween, wherein the clip comprises a plurality of spaced-apart apertures that are configured to removably receive the respective plurality of spaced-apart posts extending from the base member front surface such that the clip is removably securable to the clamp, and such that the base member forward edge portion and the retaining member forward edge portion grip the header portions of the plurality of bags adjacent the clip.

2. The bag dispensing apparatus of claim 1, wherein the clip has a U-shaped configuration with adjacent, spaced-apart first and second panels configured to receive header portions of a plurality of bags therebetween.

3. The bag dispensing apparatus of claim 2, wherein the first and second panels each comprise a plurality of spaced-apart apertures, wherein the respective plurality of apertures in each panel are aligned with the respective plurality of apertures in the other panel to removably receive the respective plurality of spaced-apart posts extending from the base member surface therethrough.

4. The bag dispensing apparatus of claim 3, wherein a hollow tube extends between the first and second panels and communicates with each pair of aligned apertures in the first and second panels, wherein each hollow tube is configured to removably receive a respective post extending from the base member surface therethrough, and wherein each hollow tube extends through the header portions of the plurality of bags.

5. The bag dispensing apparatus of claim 1, wherein the clip comprises a pair of spaced-apart apertures separated by a distance of between about one inch and about six inches.

6. The bag dispensing apparatus of claim 1, wherein the clip comprises two pairs of spaced-apart apertures, wherein the apertures in each pair are separated from each other by a distance of between about one inch and about three inches.

7. The bag dispensing apparatus of claim 3, wherein each panel comprises a pair of spaced-apart apertures separated by a distance of between about one inch and about six inches.

8. The bag dispensing apparatus of claim 3, wherein each panel comprises two pairs of spaced-apart apertures, wherein the apertures in each pair are separated from each other by a distance of between about one inches and about three inches.

9. The bag dispensing apparatus of claim 1, wherein the retaining member comprises at least one member extending from the retaining member rear surface adjacent the retaining member forward edge portion, wherein the at least one member is configured to grip the header portions of the plurality of bags adjacent the clip.

10. The bag dispensing apparatus of claim 1, wherein the base member has a planar configuration and wherein the retaining member has an arcuate configuration.

11. The bag dispensing apparatus of claim 1, wherein the base member comprises at least one aperture formed therein that is configured to support the bag dispensing apparatus on a surface.

12. The bag dispensing apparatus of claim 1, wherein the base member rear surface comprises a magnet that is configured to removably secure the bag dispensing apparatus to a magnetically attractive surface.

13. The bag dispensing apparatus of claim 1, wherein the retaining member front surface comprises promotional indicia thereon.

14. The bag dispensing apparatus of claim 1, wherein the retaining member front surface comprises a recessed portion and wherein a substrate comprising promotional indicia is disposed within the recessed portion.

15. The bag dispensing apparatus of claim 14, wherein the substrate is substantially flush with the retaining member recessed portion.

16. The bag dispensing apparatus of claim 1, wherein the base member and retaining member comprise polymeric material.

17. The bag dispensing apparatus of claim 1, wherein the retaining member comprises a rearward edge portion opposite from the retaining member forward edge portion having an arcuate configuration that facilitates a user pressing thereon to separate the forward edge portions of the base and retaining members.

18. A bag dispensing apparatus, comprising:

a clamp, comprising:

a base member having a planar configuration and comprising opposite front and rear surfaces, a forward edge portion, and a plurality of spaced-apart posts extending from the front surface adjacent the edge portion;

a retaining member having an arcuate configuration and comprising opposite front and rear surfaces and a forward edge portion, wherein the retaining member is movably secured to the base member for pivotal movement about an axis;

at least one biasing member configured to bias the retaining member about the axis such that the retaining member forward edge portion is urged towards the base member forward edge portion; and a clip configured to retain header portions of a plurality of bags in stacked adjacent relationship, wherein each bag has a receptacle portion that is separable from a respective header portion via perforations therebetween, wherein the clip has a U-shaped configuration with adjacent, spaced-apart first and second panels configured to receive header portions of the plurality of bags therebetween, wherein the first and second panels each comprise a plurality of spaced-apart apertures, wherein the respective plurality of apertures in each panel are aligned with the respective plurality of apertures in the other panel to removably receive the respective plurality of spaced-apart posts extending from the base member front surface therethrough such that the clip is removably securable to the clamp, and such that the base member forward edge portion and the retaining member forward edge portion grip the header portions of the plurality of bags adjacent the clip.

19. The bag dispensing apparatus of claim 18, wherein a hollow tube extends between the first and second panels and communicates with each pair of aligned apertures in the first and second panels, wherein each hollow tube is configured to removably receive a respective post extending from the base member surface therethrough, and wherein each hollow tube extends through the header portions of the plurality of bags.

20. The bag dispensing apparatus of claim 18, wherein the clip comprises a pair of spaced-apart apertures separated by a distance of between about one inch and about six inches.

21. The bag dispensing apparatus of claim 18, wherein the clip comprises two pairs of spaced-apart apertures, wherein the apertures in each pair are separated from each other by a distance of between about one inch and about three inches.

22. The bag dispensing apparatus of claim 18, wherein each panel comprises a pair of spaced-apart apertures separated by a distance of between about one inch and about six inches.

23. The bag dispensing apparatus of claim 18, wherein each panel comprises two pairs of spaced-apart apertures, wherein the apertures in each pair are separated from each other by a distance of between about one inch and about three inches.

24. The bag dispensing apparatus of claim 18, wherein the retaining member comprises at least one member extending from the retaining member rear surface adjacent the retaining member forward edge portion, wherein the at least one member is configured to grip the header portions of the plurality of bags adjacent the clip.

25. The bag dispensing apparatus of claim 18, wherein the base member comprises at least one aperture formed therein that is configured to support the bag dispensing apparatus on a surface.

26. The bag dispensing apparatus of claim 18, wherein the base member rear surface comprises a magnet that is configured to removably secure the bag dispensing apparatus to a magnetically attractive surface.

27. The bag dispensing apparatus of claim 18, wherein the retaining member front surface comprises promotional indicia thereon.

28. The bag dispensing apparatus of claim 18, wherein the retaining member front surface comprises a recessed portion and wherein a substrate comprising promotional indicia is disposed within the recessed portion.

29. The bag dispensing apparatus of claim 28, wherein the substrate is substantially flush with the retaining member recessed portion.

30. The bag dispensing apparatus of claim 18, wherein the base member and retaining member comprise polymeric material.

31. The bag dispensing apparatus of claim 18, wherein the retaining member comprises a rearward edge portion opposite from the retaining member forward edge portion having an arcuate configuration that facilitates a user pressing thereon to separate the forward edge portions of the base and retaining members.

* * * * *